United States Patent [19]

Mehlan et al.

[11] Patent Number: 4,509,339

[45] Date of Patent: Apr. 9, 1985

[54] AUTOMATIC DISPENSING MACHINE HAVING A COOLING UNIT

[75] Inventors: Bernd Mehlan, Herrieden; Josef Gress, Bechhofen, both of Fed. Rep. of Germany

[73] Assignee: Sielaff GmbH & Co. Automatenbau Herrieden, Fed. Rep. of Germany

[21] Appl. No.: 540,671

[22] Filed: Oct. 11, 1983

[30] Foreign Application Priority Data

Oct. 29, 1982 [DE] Fed. Rep. of Germany ..... 3240124

[51] Int. Cl.[3] ..... F25D 19/00

[52] U.S. Cl. ..... 62/450; 62/454

[58] Field of Search ..... 62/440, 450, 452, 454

[56] References Cited

U.S. PATENT DOCUMENTS

| | | | |
|---|---|---|---|
| 2,241,023 | 5/1941 | Tanner | 62/450 X |
| 2,245,234 | 6/1941 | Tanner | 62/450 X |
| 2,561,276 | 7/1951 | Hill | 62/450 X |
| 2,672,029 | 3/1954 | Saunders | 62/454 X |
| 2,734,351 | 2/1956 | Stewart | 62/450 |
| 3,785,168 | 1/1974 | Domingorene | 62/454 X |

*Primary Examiner*—Lloyd L. King

*Attorney, Agent, or Firm*—McGlew and Tuttle

[57] ABSTRACT

An automatic selling machine is equipped with a cooling system whose evaporator and evaporator fan are dispensed in the goods compartment on an insulating intermediate bottom of the machine housing, and whose condenser, condenser fan, and compressor are accommodated below the intermediate bottom. The cooling system is an assembly to be exchanged as a unit. For this purpose, the intermediate bottom is provided with an opening having peripheral shoulders on which an insulating supporting plate closing the opening rests. The evaporator is mounted above the plate, while the condenser, the compressor, and the condenser fan are mounted at the underside of the plate.

10 Claims, 2 Drawing Figures

AUTOMATIC DISPENSING MACHINE HAVING A COOLING UNIT

FIELD AND BACKGROUND OF THE INVENTION

This invention relates in general to dispensing devices and coolers and to a new and useful dispensing device including a housing having an upper goods compartment and a lower equipment compartment with insulation surrounding the goods compartment which has an opening at the lower end of the goods compartment forming a ledge with a supporting plate for a cooling unit mounted on the ledge and containing an evaporator on its top face located in the equipment compartment and the remaining portion of the cooling unit on the bottom face.

Automatic vending machines are employed for selling or dispensing goods, particularly cool beverages, which are to remain cool up to the time of their delivery. In prior art designs, the evaporator is mounted on an intermediate bottom or platform forming a fixed part of the machine. The needed evaporator connections are passed through bores in the intermediate bottom into the space below where the condenser and compressor are accommodated. This design has the disadvantage that the cooling equipment of the selling machine is very difficult to exchange.

To provide the entire cooling equipment below a continuous solid bottom does facilitate the exchange, however, introduces problems with the cooling.

SUMMARY OF THE INVENTION

The invention is directed to a machine having cooling equipment designed as an exchangeable unit, without the evaporator being provided at a location unfavorably affecting the cooling of the goods compartment.

In accordance with the invention, it is provided that the cooling unit includes an insulated support plate carrying on its top an evaporator cooler and below carrying the remainder of the cooling unit which are maintained at higher temperatures. The entire cooling equipment is thus secured to the insulating supporting plate and can be assembled as a unit in advance. By inserting the insulating supporting plate into the opening of an intermediate bottom of the dispensing cabinet, the entire cooling system is put in place in the housing of the machine. With this assembly in place, the supporting plate provides the necessary insulation between the goods compartment to be cooled and the mounting space below. An exchange of the cooling system is easy, by removing the insulating supporting plate. With the supporting plate in place in the opening, the evaporator is disposed at a favorable location within the goods compartment, namely free on the intermediate bottom. The air cooled on the evaporator and circulated by the evaporator fan is then freely distributed in the goods compartment. There is no risk of undercooling zones near the evaporator and unsatisfactorily cooling zones which are remote.

Preferably, the intermediate bottom is U-shaped and has an opening at the side of the selling machine door, so that the insulating supporting plate can be pushed onto or withdrawn from the shoulders in the horizontal direction.

According to a development of the invention, a channel-section support is secured to the underside of the insulating supporting plate, and the condenser, the condenser fan, and the compressor are mounted on the bottom of the channel.

The channel-section support forms a circulation duct for the air passing by the condenser. Moreover, with the unit withdrawn from, thus outside, the selling machine, the bottom of the channel-section support forms a base or stand.

The fan of the condenser is advantageously disposed in the channel-section support between the condenser and the compressor. This provides for a safe, contact proof position of the fan, in accordance with regulations.

According to an advantageous development of the invention, the evaporator fan is mounted on the insulating supporting plate behind the evaporator, so that it also forms a part of the assembly which can be removed as a unit.

Preferably, the insulated plate has a metal jacket on its underside and a plastic jacket on it top. The metal jacket gives the structure the wanted mechanical stability for supporting the compressor, the condenser fan and the condenser. The plastic jacket prevents heat from dissipating from the metal jacket into the goods compartment. A central plastic foam layer provides the needed insulation.

Accordingly it is an object of the invention to provide a cooling unit for use with a cooler housing which has an upper insulated goods compartment and a lower equipment compartment with an opening therebetween having a surrounding support ledge and which comprises an insulated mounting plate engaged on the ledge and a cooling unit associated with the mounting plate which has an evaporator cooler secured to the plate on the top thereof for location within the goods compartment and including a compressor, condenser and fan unit secured to the bottom of the mounting plate.

A further object of the invention is to provide an improved selling machine or dispenser which includes upper and lower compartments separated by a mounting plate for portions of a cooling unit.

A further object of the invention is to provide a cooling unit for a cooler housing and an automatic selling machine which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
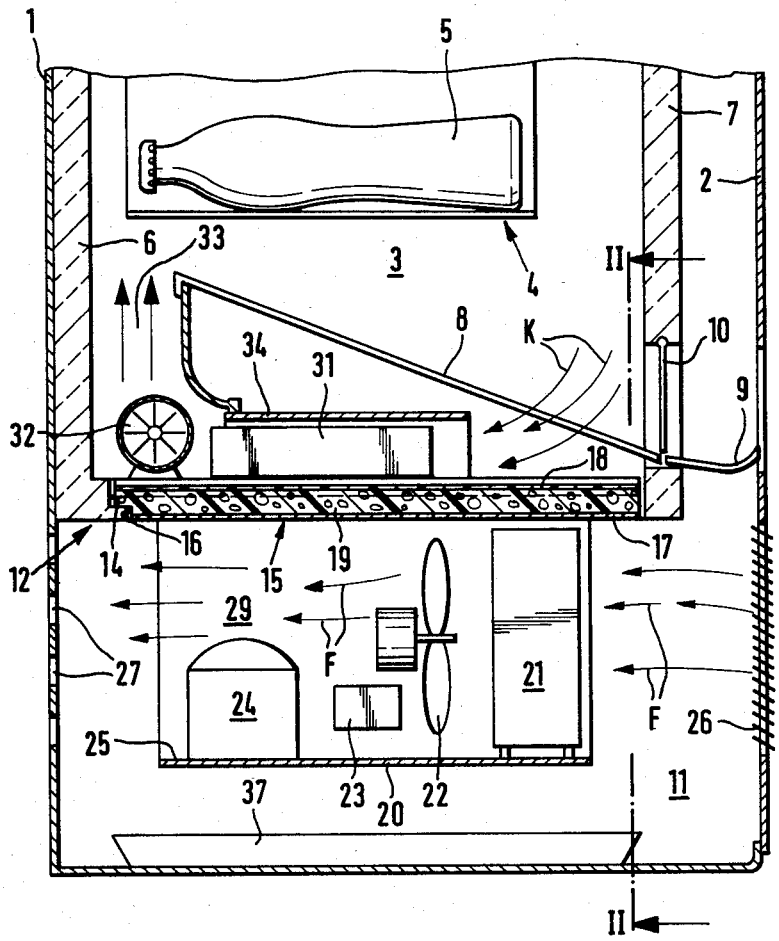
FIG. 1 is a sectional side view of the lower part of a dispenser or an automatic vending machine, taken along the line I—I of FIG. 2.

Referring to the drawings in particular the invention embodied therein comprises a cooling unit for use with a refrigerated vending machine 1 which has an upper insulated goods compartment 3 and a lower equipment compartment 11. An opening 13 is defined in an intermediate bottom between the upper and lower compartments and it has a surrounding support ledge 14 which provides a support for an insulated mounting plate 14. In accordance with the invention a cooling unit is associated with the mounting plate 15 and has an evaporator cooler secured to the plate on the top thereof which is located within the goods compartment 3 and includes a compressor condenser and fan secured to the back of the plate which is positioned in the equipment compartment upon mounting of the plate on the ledge.

An automatic vending machine for beverages in bottles or cans comprises housing 1 closed on its front side with an outer door 2. In a goods compartment 3 inside the housing, a shelving structure 4 for the individual goods, i.e. the cans or bottles 5 is provided. The goods compartment 3 is surrounded by an insulating layer 6. The front side of goods compartment 3 is formed by an insulated inner door 7 mounted behind the outer door 2.

Below shelving structure 4, a delivery chute 8 is provided which terminates, in the zone between the inner door 7 and outer door 2, in a pickup trough 9. A lid serving as a cooling trap 10 is suspended from the inner door 7.

Below goods compartment 3, an equipment compartment 11 is provided which is separated and thermally insulated from goods compartment 3 by an intermediate bottom 12. Bottom 12 is spaced above a lower end of the housing 1. As far as it is a fixed part of automatic selling machine 1, intermediate bottom 12 of a U-shape with a bottom opening 13 which is open toward inner door 7.

Along the periphery of opening 13, a shoulder 14 is provided. Reposing on this shoulder is an insulating supporting plate 15 having a ledge 16 providing a support for the shoulder 14.

Insulating supporting plate 15 comprises a solid metal jacket lower plate 17 conformable to ledge 16 and resting on shoulder 14 without projecting into goods compartment 3. On its top side, insulating supporting plate 15 is provided with a sectional jacket of plastic 18. The space between jackets 17 and 18 is filled with a layer 19 of polyurethane foam material.

A support 20 in the shape of a channel section is secured from below to metal jacket 17. An enclosed space is thus formed at the underside of insulating supporting plate 15. In this space, a condenser 21, a condenser fan 22, an electrical controller 23, and a compressor 24 are provided. The compressor 24, the motor 22 of the fan, and the condenser 21 are secured to the bottom 25 of support 20.

Fan 22 is disposed between condenser 21 and compressor 24. This makes sure that the fan is protected or contact proof. Downstream (direction F) of the fan 22, consecutively, the condenser 21 and the compressor 24 are provided. Compressor 24 is cooled by the blown air. To maintain the needed air current, a grate 26 is provided at the front side of the selling machine, and perforations 27 on the opposite side, with the grate and the perforations being aligned in the direction F of the air current.

Controller 23 is secured to one of side walls 28,29 and located between compressor 24 and fan 22. Its setting knob 30 is provided at the outside of the respective side wall. This ensures that controller 23 is also contact proof.

To the upper surface of insulating supporting plate 15, an evaporator 31, particularly of the lamination type, is secured. Behind the evaporator a cross current ventilator 32 is mounted as an evaporator fan.

Evaporator 31, compresor 24, and condenser 21 form together a usual cooling system whose connection lines and throttle valve are not shown. The connecting lines between evaporator 31, compressor 24 and condenser 21 are passed through insulating supporting plate 15. The connecting lines between compressor 24 and condenser 21 extend within channel-section support 20.

Evaporator 31 and its fan 32 are placed directly on the bottom of goods compartment 3, with insulating supporting plate 15 itself forming the greatest part of the area of this intermediate bottom 12. Evaporator 31 and cross current fan 32 are thus not accommodated in isolated secondary spaces.

Evaporator 31 is disposed below delivery chute 8. Behind delivery chute 8, above cross current or evaporator fan 32, a vertically open enclosure 33 is formed into which fan 32 blows the cooled air. Deivery chute 8 is provided with perforations through which the air to be cooled is taken down in the direction K. To direct the air current through evaporator 31, an air conducting baffle 34 is provided thereabove. The baffle may be a fixed part either of insulating supporting plate 15 or of goods compartment 3.

The connecting cable of cross current fan 32 is passed through insulating plate 13 to controller 23. Insulating plate 15 further supports a temperature sensor for measuring the temperature in goods compartment 3, which also is connected to controller 23.

Figure 2:
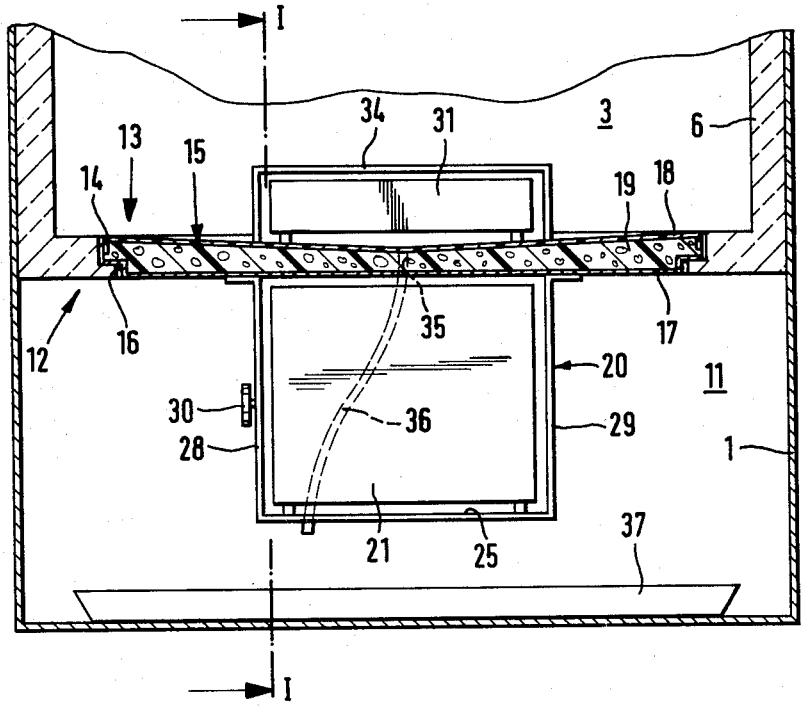
FIG. 2 is a sectional front view taken along the line II—II of FIG. 1.

As shown in FIGS. 1 and 2, insulating supporting plate 15 forms the major part of intermediate bottom 12 by which goods compartment 3 is separated from space 11 provided for the equipment. Insulating plate 15 may even be of a size completely replacing intermediate bottom 12, in which instance the bearing shoulders are provided directly below the vertical insulating walls 6 of the housing. Conversely, however, insulating plate 15 may be a narrow part forming substantially only a rail to be inserted in a slot-shaped opening of intermediate bottom 12. In such an instance, insulating plate 15 will be substantially narrower and may also be shorter than evaporator 31 or condenser 21. It will still be wide enough, however, to allow to pass therethrough the lines needed for interconnecting evaporator 31, condenser 21, and compressor 24.

In the zone of evaporator 31, insulating supporting plate 15 slopes slightly down to a hole 35 provided therein, to which a flexible tube 36 is connected. Flexible tube 36 leads to a collecting tray 37, so that liquid, such as water of condensation, which may accumulate in goods compartment 3, can be drained.

With the selling machine in service, both compressor 24 and the two fans 22 and 32 are in operation. An air circulation in the direction of arrow K then establishes in goods compartment 3, with the warmer air being drawn in by fan 32 along inner door 7, to be cooled by evaporator 31, and the cooled air being conducted to the goods in space 3. Since evaporator 31 is located above intermediate bottom 12, the cross current fan 32 makes sure that the air circulation will include the entire depth and width of the goods compartment 3.

Insulating supporting plate 15 ensures the necessary thermal separation of goods compartment 3 from the equipment space 11. On the other hand, the needed air circulation F in space 11 can establish without being restricted by the cooling section of the system.

If necessary for maintenance, the cooling assembly forming a unit can be removed from the machine by opening both doors 2 and 7 and withdrawing insulating supporting plate 15. This withdrawal does not additionally stress the connections between the individual parts of the cooling system, since they are not mechanically affected by this operation. The entire cooling unit thus removed can be set down on its base 25 in stable position, without thereby stressing the connections.

With the maintenance work done, the cooling unit can easily be reinserted into the machine, and, upon plugging in, is ready for service again.

While a specific embodiment of the invention has been shown and described in detail to illustrate the application of the principles of the invention, it will be understood that the invention may be embodied otherwise without departing from such principles.

What is claimed is:

1. A refrigerated vending machine comprising:

a housing (1) having a front opening and a lower end;

a housing door (2) connected to said housing and closing said front opening of said housing;

an insulated goods compartment (3) in said housing (1), said insulated goods compartment having a front opening and an intermediate bottom (12) space above said lower end of said housing, said housing defining an equipment compartment (11) below said intermediate bottom, said intermediate bottom having a U-shaped opening (13) therein having a supporting shoulder (14), said U-shaped opening opening into said front opening of said insulated goods compartment;

a compartment door (7) connected to said goods compartment and closing said front opening of said goods compartment;

a shelving structure (4) mounted in said goods compartment above said intermediate bottom (12) for supporting goods to be vended;

an insulated mounting plate (15) in said U-shaped opening (13) and supported on said supporting shoulder (14), said insulated mounting plate being slidable forwardly out of said U-shaped opening with said housing door and said compartment door each in an open position for opening said front opening of said housing and said compartment; and refrigeration means connected to said mounting plate for cooling said goods compartment, said refrigeration means being removable with said mounting plate from said housing through said front opening of said housing;

said refrigeration means comprising;

a vaporator (31) mounted on said mounting plate in said goods compartment and below said shelving structure;

an evaporator fan (32) mounted on said mounting plate in said goods compartment and below said shelving structure;

a condenser (21) mounted under said mounting plate and in said equipment compartment (11);

a condenser fan (22) mounted under said mounting plate in said equipment compartment; and a compressor (24) mounted under said mounting plate and in said equipment compartment;

whereby said refrigeration means can be removed by moving said compartment door and said housing door into their open position for opening said front openings of said compartment and housing, and sliding said mounting plate (15) forwardly through said front openings without interferring with goods in said supporting structure (4).

2. A refrigerated vending machine according to claim 1 including a channel (20) connected to an underside of said mounting plate (15), said condenser (21), condenser fan (22) and compressor (24) being mounted on said channel under said mounting plate.

3. A refrigerated vending machine according to claim 1, wherein said channel is U-shaped and has a base (25) for supporting said condenser, condenser fan and compressor, and sidewalls (28,29) connected between said base and said underside of said mounting plate, said mounting plate (15) being wider than a spacing between said sidewalls (28,29) so that said refrigeration means can be lifted by holding opposite sides of said mounting plate and set down on said base when removed from said housing.

4. A refrigerated vending machine according to claim 3, wherein said intermediate bottom (12) and said insulated mounting plate (15) extend in a common plane, said supporting shoulder (14) comprising a continuous step around said U-shaped opening (13).

5. A refrigerated vending machine according to claim 4, wherein said condenser fan (22) is mounted on said base (25) between said condenser (21) and said compressor (24), said compressor, condenser and condenser fan being mounted between said sidewalls (28,29).

6. A refrigerated vending machine according to claim 5, wherein said evaporator fan (32) is mounted on said mounting plate behind said evaporator (31) with respect to said compartment door (7).

7. A refrigerated vending machine according to claim 6 including a delivery chute (8) sloping downwardly toward said compartment door (7) and disposed above said refrigeration means in said insulated goods compartment (3).

8. A refrigerated vending machine according to claim 7, wherein said insulated mounted plate (15) comprises a lower metal jacket (17) supported on said continuous step (14), an upper plastic jacket (18) having a cross-sectional shape for channelling fluid to a hole in said plastic jacket, said plastic jacket spaced above said metal jacket, and foamed plastic insulating material (19) disposed in a space between said plastic jacket and said metal jacket.

9. A refrigerated vending machine according to claim 8, wherein said refrigeration means includes a controller (23) mounted on said channel (20) below said mounting plate and between said condenser (21) and said compressor (24) for controlling operation of said refrigeration means to maintain a selected temperature in said goods compartment (3).

10. A refrigerated vending machine according to claim 9, wherein said mounting plate (15) includes a hole (35) therethrough for draining fluid from said plastic jacket (18), a hose (36) connected to said hole (35) and extending downwardly through said equipment compartment (11), and a pan (37) positioned in said equipment compartment (11) below said refrigeration means and below said hose (36) for receiving fluid from said hose.

* * * * *